US009334635B2

(12) United States Patent
Keiter et al.

(10) Patent No.: US 9,334,635 B2
(45) Date of Patent: May 10, 2016

(54) FAUCET WITH GUIDED PULL-OUT SPOUT

(71) Applicant: Grohe AG, Hemer (DE)

(72) Inventors: Dieter Keiter, Menden (DE); Frank-Thomas Luig, Menden (DE); Matthias Schlueter, Dortmund (DE)

(73) Assignee: Grohe AG, Hemer (DE)

( * ) Notice: Subject to any disclaimer, the term of this patent is extended or adjusted under 35 U.S.C. 154(b) by 288 days.

(21) Appl. No.: 13/911,651

(22) Filed: Jun. 6, 2013

(65) Prior Publication Data

US 2013/0327853 A1 Dec. 12, 2013

(30) Foreign Application Priority Data

Jun. 12, 2012 (DE) ..... 10 2012 011 478

(51) Int. Cl.
*E03C 1/04* (2006.01)

(52) U.S. Cl.
CPC ..... *E03C 1/0404* (2013.01); *E03C 2001/0415* (2013.01)

(58) Field of Classification Search
CPC ..... E03C 1/0404
USPC ..... 4/675–678; 137/801; 239/525, 588
See application file for complete search history.

(56) References Cited

U.S. PATENT DOCUMENTS

| | | | |
|---|---|---|---|
| 6,810,539 | B2 | 11/2004 | Bosio |
| 2002/0170608 | A1 | 11/2002 | Marty et al. |
| 2006/0283511 | A1 | 12/2006 | Nelson |
| 2010/0170587 | A1 | 7/2010 | Kaess |

FOREIGN PATENT DOCUMENTS

| | | | |
|---|---|---|---|
| DE | 691 08 853 | T2 | 8/1995 |
| DE | 20 2005 013 425 | U1 | 12/2005 |
| DE | 603 03 465 | T2 | 7/2006 |
| DE | 10 2007 009 408 | B4 | 11/2008 |

*Primary Examiner* — Tuan N Nguyen
(74) *Attorney, Agent, or Firm* — Muncy, Geissler, Olds & Lowe, P.C.

(57) ABSTRACT

A faucet having a pull-out sprayer that is attached to a spray hose. The faucet also has a housing with an end region to receive the sprayer and a feedthrough for passage of the sprayer hose through the housing, and at least one first guide for spacing the sprayer hose from an inner wall surface of the feedthrough, the guide being provided at least in an end region.

10 Claims, 5 Drawing Sheets

FAUCET WITH GUIDED PULL-OUT SPOUT

This nonprovisional application claims priority under 35 U.S.C. §119(a) to German Patent Application No. DE 10 2012 011 478.8, which was filed in Germany on Jun. 12, 2012, and which is herein incorporated by reference.

BACKGROUND OF THE INVENTION

1. Field of the Invention

The present invention concerns a faucet with a pull-out sprayer that is attached to a spray hose, wherein the faucet further has a housing with an end region to receive the sprayer and a feedthrough for passage of the sprayer hose through the housing. Faucets of this nature are used in the field of plumbing installations. In particular, such faucets are employed on sinks or wash basins.

2. Description of the Background Art

Thus, for example, a faucet with a pull-out spout is known from DE 10 2007 009 408 B4. The faucet known therefrom makes it possible to take a sprayer from the faucet as needed and pull it out of the faucet together with the hose. In this design, a guide tube in the bottom region of the faucet is provided with a guide element that serves to keep the hose at a predetermined distance from the lines coming together in the bottom region of the faucet.

However, with other conventional faucets it is noted that complete retraction of the hose and sprayer to a desired end position does not always take place.

SUMMARY OF THE INVENTION

It is therefore an object of the present invention is to provide a faucet that is improved such that the hose including sprayer is reliably retracted into its end position after being pulled out. Moreover, the faucet must be economical to produce and must be reliable.

In an embodiment, a faucet includes at least one first guide for spacing the sprayer hose from an inner wall surface of the feedthrough, the guide being provided at least in the end region.

Through the use of the first guide, the faucet according to an embodiment of the invention avoids a large contact area between the sprayer hose and the inner wall surface of the feedthrough, which makes it possible to significantly reduce the frictional forces that must be overcome in order to retract the hose to an end position. In this context, the end position can be understood to mean the position that the sprayer reaches when the hose is pulled fully into the housing. The contact area can be made linear as well as areal.

In this context, the radial spacing can be understood to mean that the first guide holds the sprayer hose that is guided so as to slide along it at a defined distance from the inner wall surface of the feedthrough. As a general rule, the cross-sectional shapes of the feedthroughs can be circular, oval, or elliptical, wherein a spacing in the radial direction toward the center point of the applicable radii of these cross-sections is involved in these cases. The spacing can also be applicable in connection with any other desired cross-sectional shapes. A factor is a spacing of the sprayer hose from the inner wall surface of the feedthrough. In addition to reducing the frictional forces required to retract the sprayer to the end position, which generally are applied by means of springs, the present invention is at the same time able to overcome a further problem that prevents reliable retraction of the sprayer to the end position. As the dead weight of the sprayer increases, the effect arises that the hose slides over an edge in the end region of the faucet. Now if a location on the sprayer having a protrusion arrives at this edge during retraction, this protrusion will catch on the edge and prevent complete retraction of the sprayer.

Consequently, in addition to reducing the frictional forces, the spacing of the sprayer hose from the inner wall surface of the feedthrough according to an embodiment of the present invention prevents catching of the protrusion on the edge of the end region. Because of the two aforementioned advantages achieved by the faucet according to the invention, improved reliability in retracting the sprayer to its end position can be achieved in comparison with the prior art.

In an embodiment of the invention, provision is further made that the first guide can be arranged at least on the housing or on the hose. While a sliding surface on the housing as a guide is already suitable for achieving the described advantages, it is also possible, either alternatively or in combination, to provide a guide on the hose that guides the sprayer hose at a defined spacing from the inner wall surface of the feedthrough. This can be achieved by means of a number of spacer arms distributed over the length of the hose, for example.

In another embodiment of the invention, the first guide has at least one sliding surface that guides the sprayer hose at a distance from the inner wall surface. Plastic components that form an especially favorable pairing of friction coefficients in combination with the material of the sprayer hose can be used for this purpose, for example. A goal here is to keep the retraction forces that must be applied to retract the sprayer to the end position as low as possible. Materials that may be considered are plastics, metals, and ceramics, for example.

It is especially advantageous in this design for the sliding surface to be arranged such that it works together with a bottom side of the hose. Since the dead weight of the sprayer head pulls the sprayer hose downward in the direction of gravity, the sprayer hose generally rests with its bottom side on the inner wall surface of the feedthrough. This being the case, in an embodiment, it is sufficient to provide sliding surfaces that merely work together with the bottom side of the sprayer hose and thus space it from the inner wall surface.

Furthermore, the sliding surface of the first guide can be designed as a tongue. Firstly, such a tongue can carry out elastic movements and thus perform movement compensation during the pulling out and retraction of the sprayer hose. Moreover, a tongue can be made curved so that the contact area between the sprayer hose and the first guide, and hence also the requisite frictional force, is minimized. Lastly, the tongue shape has yet another advantage, which resides in the fact that the tongue contacts the sprayer hose but also can be braced in a minimum of one location, preferably in at least two locations, on the inner wall surface of the feedthrough.

In this regard, the first guide can be made annular with at least one tongue located thereon. The annular design makes it possible to fasten the first guide in the end region of the faucet in a simple manner. The annular guide in this design can optionally be pushed in, pushed on, clipped, threaded, interlocked, or fastened in another known manner.

Furthermore, it is also advantageous to additionally provide a second guide that aligns the sprayer hose in its end position in its circumferential direction relative to the end region of the faucet. The motion in the circumferential direction here corresponds to a rotation of the hose about its longitudinal axis, wherein the second guide ensures that the sprayer is always held in a defined orientation in its end position. Unintentional twisting of the sprayer is thus reliably prevented.

To this end, it is advantageous for the second guide to be annular in design with at least one beveled first guide surface located thereon. The second guide can be located on the same ring as the first guide, for example, and has at least one first guide surface. The first guide surface acts as a centering surface and is beveled so that the sprayer comes into contact therewith shortly before reaching the end position and is guided into the desired defined end position as the retraction process continues.

In an embodiment, for this purpose the second guide has at least one first guide surface and one second guide surface that is complementary in design thereto, which work together in the end region of the faucet. By this means, a first guide surface can be located on the housing and a second guide surface can be located on the hose or sprayer.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
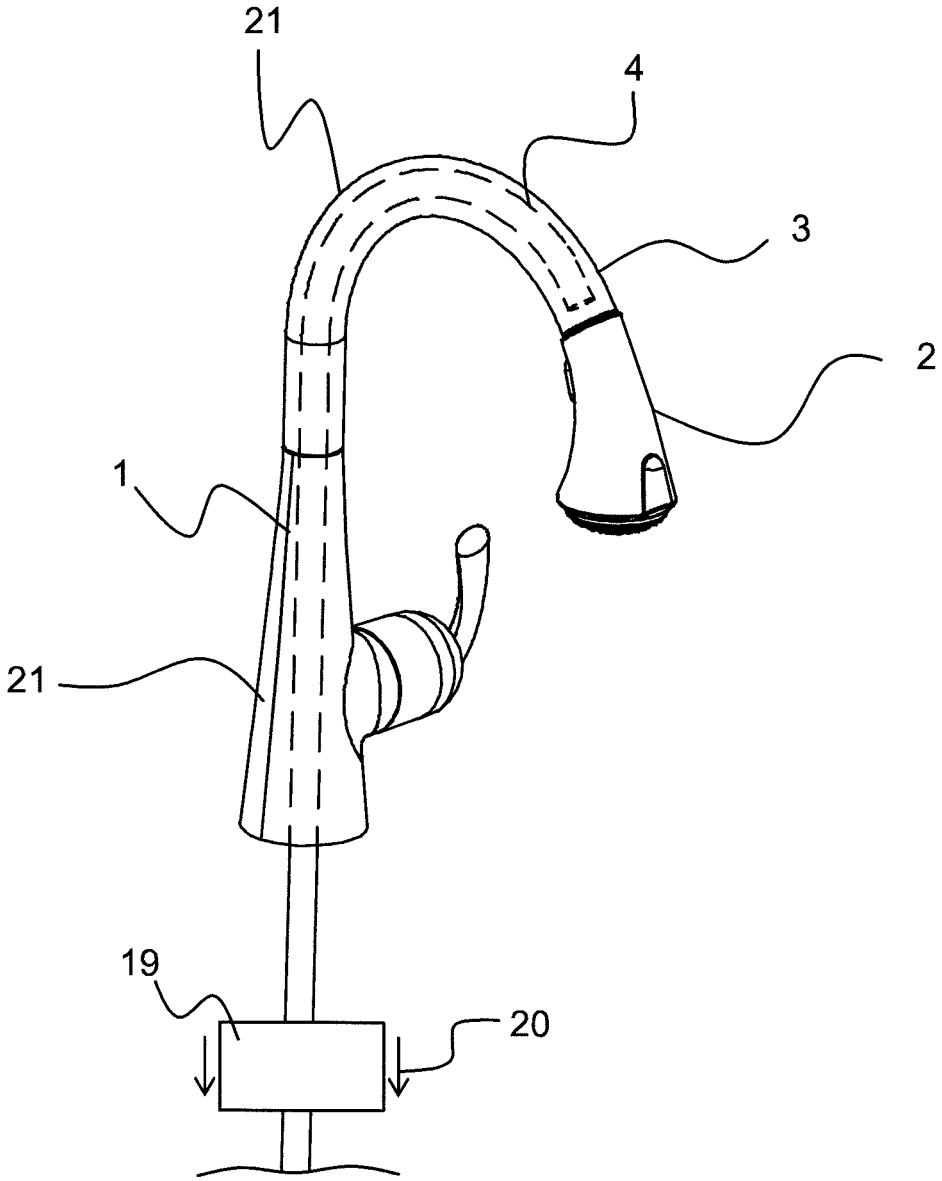
FIG. 1 is an oblique view of a faucet according to an embodiment of the invention with a sprayer.

FIG. 1 shows an oblique view of a faucet 1 according to the invention with a sprayer 2. The sprayer 2 here is shown in an end position where it rests against an end region 3 of the faucet 1. The sprayer hose 4 located within the faucet 1 is indicated by dashed lines, and extends from the sprayer 2 through the entire faucet 1 and beyond. A retraction device 19, which exerts a retraction force 20 in the direction of the arrow on the sprayer hose 4, engages at the bottom end of the sprayer hose 4.

Figure 2:
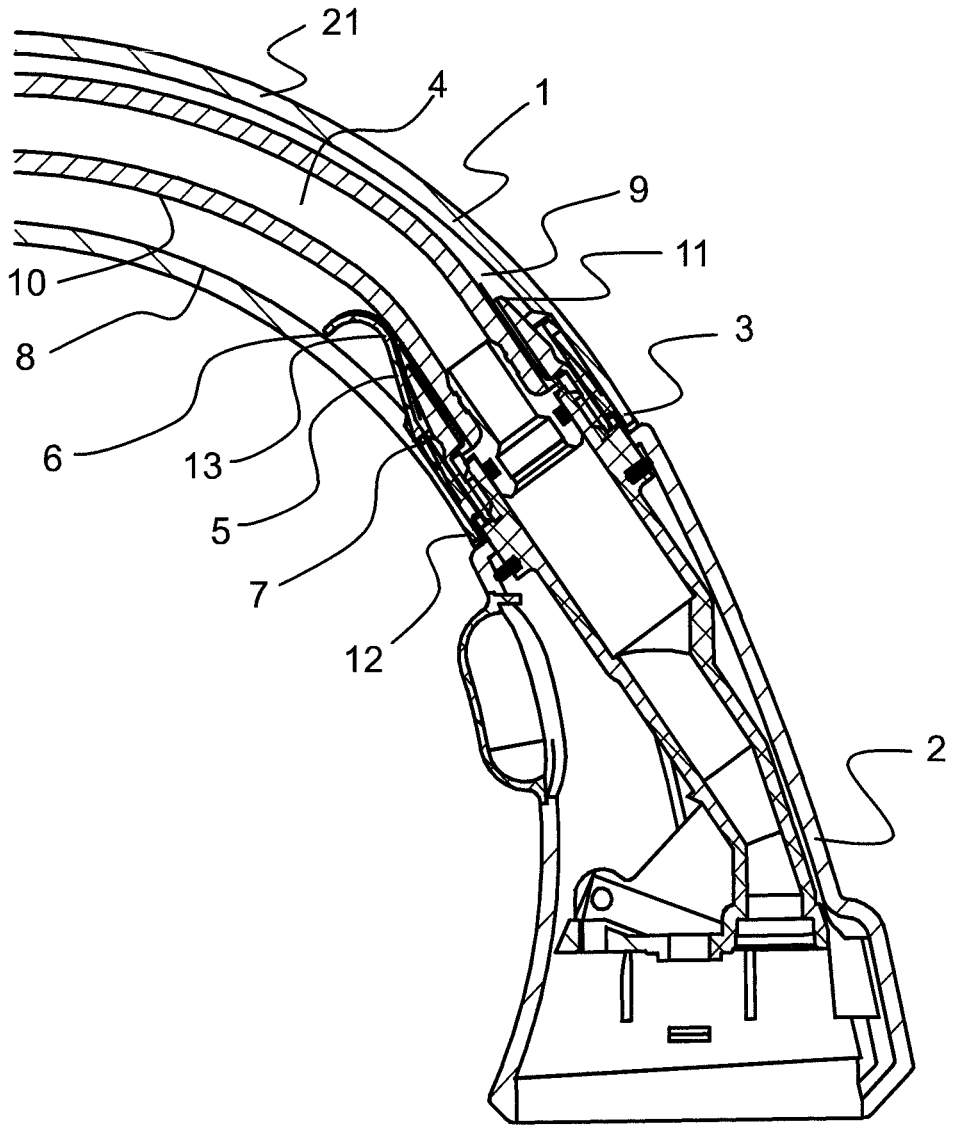
FIG. 2 is a cross-sectional view through an end region of a faucet according to an embodiment of the invention with a sprayer in the end position.

FIG. 2 shows the end region 3 of a faucet 1 according to the invention with the sprayer 2, once again in a cross-sectional view. Clearly visible therein is the sprayer hose 4, which is guided along a first guide 5. The first guide 5 is designed in the shape of a tongue 13, which is supported at a first location 6 and a second location 7 against an inner wall surface 8 of a feedthrough 9 through the faucet 1. It is evident here that the tongue 13 of the first guide 5 is embodied only at a bottom side 10 of the sprayer hose 4. It is also evident that the first guide 5 is annular in the end region 3. Fastening of the first guide 5 in the end region 3 can be accomplished by all known fastening methods, such as plugging, gluing, welding, threading, snap-fitting, clamping, etc. Moreover, the guide 5 can alternatively or additionally be provided on the sprayer hose 4 to keep the sprayer hose 4 spaced apart from the inner wall surfaces 8 during pulling out and retraction. It is also evident in FIG. 2 that without the guide 5 of the present invention, a protrusion 11 of the sprayer hose 4 would be caught on a bottom edge 12 of the faucet 1 during retraction of the sprayer hose 4 to the end position shown, with the result that complete retraction could not be achieved, or could only be achieved with very high retraction forces 20. The sprayer hose 4 is brought by the tongue 13 into a collinear position to the spout embodied in the end region 3. This prevents the sprayer hose 4 from coming into contact with the inner wall surface 8 due to gravity and pushing the sprayer 2 out of the position required for insertion.

FIG. 3 once again shows the first guide 5 as an individual part. The sliding surface of the first guide 5, implemented as a tongue 13, is again clearly evident here. The sprayer hose 4 slides over this tongue 13 during retraction and pull-out. Moreover, in the installed state the edge 14 of the tongue 13 can be supported at a first location 6 of the inner wall surface 8. At the same time, a second guide 15, which has approximately V-shaped first guide surfaces 16 on the inside of the annular structure, is formed on this component in addition to the first guide 5. The first guide surfaces 16, designed as centering surfaces, serve to align the sprayer 2 in the circumferential direction of the annular first guide 5 during the motion of the sprayer into the end position.

Figure 3:
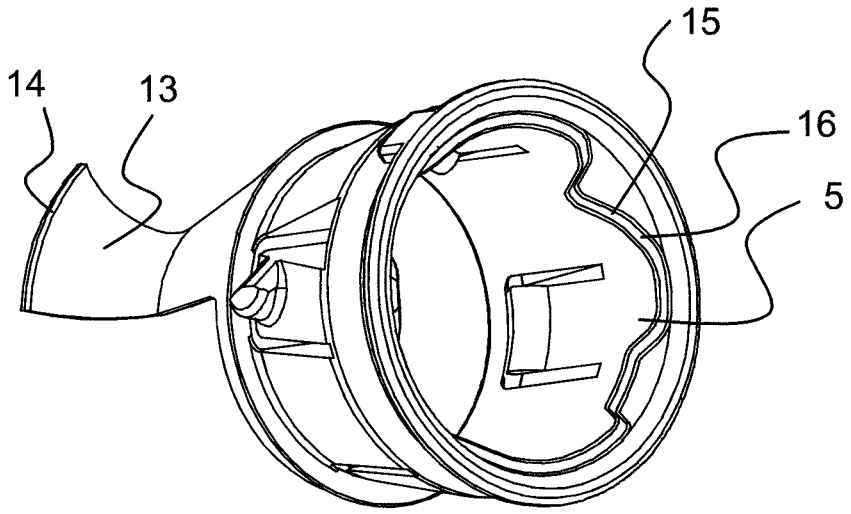
FIG. 3 is a first view of a clamping sleeve with a tongue.
Figure 4:
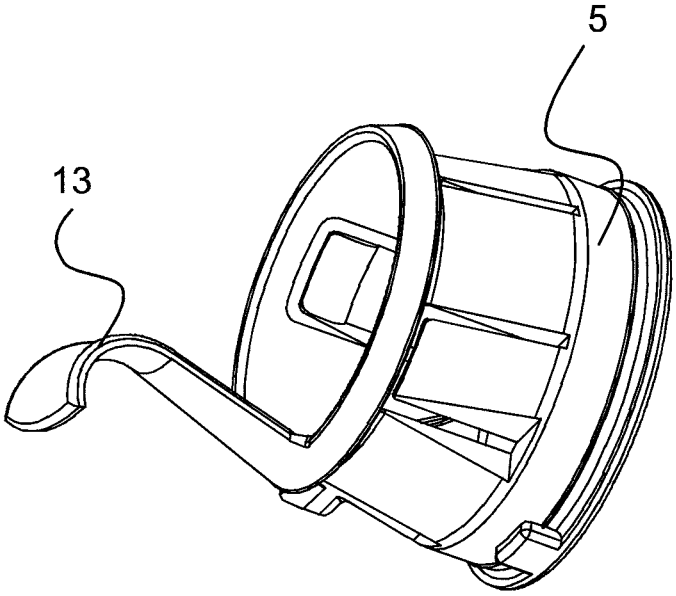
FIG. 4 is a second view of a clamping sleeve with a tongue.

FIG. 4 again shows the first guide 5 from FIG. 3, in a different perspective. It is evident that the first guide 5 is designed as a clamping sleeve with the tongue 13 located thereon. The clamping sleeve can be installed and removed at will as needed, with the result that, for example, easy replacement is possible if wear of the first or second guide (5, 15) should occur.

Figure 5:
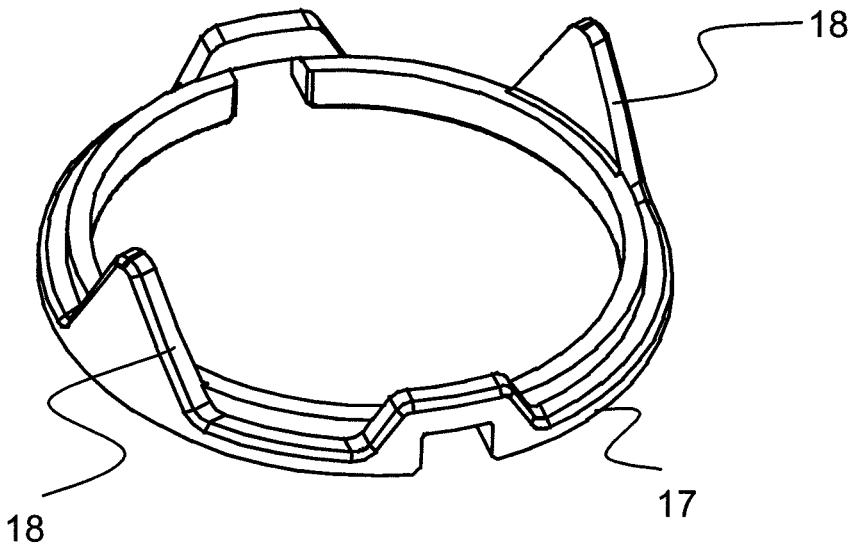
FIG. 5 is an oblique view of an alignment ring.

Lastly, FIG. 5 shows a ring 17 that has second guide surfaces 18 that are designed as a centering component and that are intended to work together with the first centering surfaces 16 of the second guide 15. To this end, the ring 17 is located on the sprayer 2, wherein the second guide 18 is designed as triangular points and face in the direction of the first guide 5. Moreover, the centering component 18 is arranged on a circumference of the ring 17 such that the sprayer 2 can only be moved fully into its end position in a single orientation. This can be achieved by the means that the second guide surfaces 18 are located asymmetrically on the ring 17, for example. To this end, the first guide surfaces 16 of the second guide 15 are designed to be complementary to the second guide surfaces 18. Alternatively, the guide surfaces 18 can also be integrated into the molded body of the sprayer 2.

The present invention is not limited to the exemplary embodiments shown. Rather, numerous variations of the invention are possible within the scope of the claims. Thus, for example, any other suitable geometries can be employed in place of the shapes described.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A faucet comprising:

a spray hose;

a pull-out sprayer attached to the spray hose;

a housing with an end region adapted to receive the sprayer and with a feedthrough to allow for passage of the spray hose through the housing; and at least one first guide adapted to space the spray hose from an inner wall surface of the feedthrough, the at least one first guide being provided at least in the end region of the housing, wherein the first guide is annular with at least one tongue located thereon, wherein a first end of the at least one tongue is integral with the first guide and a second, distal end of the at least one tongue is supported against the inner wall surface of the feedthrough, and wherein the at least one tongue includes an arcuate-shaped portion located between the first end and the second end thereof, the arcuate-shaped portion directly contacting the spray hose.

2. The faucet according to claim 1, wherein the first guide is arranged at least on the housing or on the spray hose.

3. The faucet according to claim 1, wherein the first guide has at least one sliding surface that guides the spray hose at a distance from the inner wall surface, a surface of the arcuate-shaped portion of the at least one tongue forming the at least one sliding surface.

4. The faucet according to claim 3, wherein the sliding surface is arranged such that the sliding surface works together with a bottom side of the spray hose.

5. The faucet according to claim 3, wherein the second, distal end of the at least one tongue is supported in at least one location on the inner wall surface.

6. The faucet according to claim 1, further comprising a second guide that aligns the spray hose in a fully retracted state in its circumferential direction relative to the end region of the faucet.

7. The faucet according to claim 6, wherein the second guide is annular with at least one beveled first guide surface located thereon.

8. The faucet according to claim 6, wherein the second guide has at least one first guide surface, and the faucet further comprising a ring attached to the sprayer, the ring having at least one second guide surface that is complementary in shape to the at least one first guide surface, such that the at least one first guide surface and the at least one second guide surface fit together in the end region of the faucet.

9. The faucet according to claim 8, wherein the at least one first guide surface of the second guide is a substantially v-shaped groove and the at least one second guide surface of the second guide is a substantially triangular-shaped point that fits in the substantially v-shaped groove when the spray hose is in the fully retracted state.

10. The faucet according to claim 6, wherein the second guide is provided on an inner surface of the first guide.

* * * * *